US006379423B1

(12) United States Patent
Vuletic

(10) Patent No.: US 6,379,423 B1
(45) Date of Patent: Apr. 30, 2002

(54) DEVICE AND METHOD FOR PRODUCING SPONGE IRON

(75) Inventor: Bogdan Vuletic, Duesseldorf (DE)

(73) Assignee: Deutsche Voest-Alpine Industrieanlagenbau GmbH (DE)

( * ) Notice: Subject to any disclaimer, the term of this patent is extended or adjusted under 35 U.S.C. 154(b) by 0 days.

(21) Appl. No.: 09/202,263

(22) PCT Filed: May 30, 1997

(86) PCT No.: PCT/DE97/01127

§ 371 Date: Mar. 12, 1999

§ 102(e) Date: Mar. 12, 1999

(87) PCT Pub. No.: WO97/47773

PCT Pub. Date: Dec. 18, 1997

(30) Foreign Application Priority Data

Jun. 12, 1996 (DE) ..... 196 25 127

(51) Int. Cl.[7] ..... C21B 11/02
(52) U.S. Cl. ..... 75/492; 266/160; 266/189
(58) Field of Search ..... 266/189, 160; 75/490, 492

(56) References Cited

U.S. PATENT DOCUMENTS

| | | | | |
|---|---|---|---|---|
| 2,862,808 A | | 12/1958 | DeJahn | |
| 3,850,616 A | | 11/1974 | Cruse, Jr. | |
| 4,118,017 A | | 10/1978 | Hendrickson | |
| 4,205,831 A | | 6/1980 | Vera et al. | |
| 4,448,402 A | * | 5/1984 | Weber et al. | 75/492 |

FOREIGN PATENT DOCUMENTS

| | | |
|---|---|---|
| DE | 482 111 | 8/1929 |
| JP | 61276909 | 6/1986 |
| JP | 62994127 | 12/1987 |
| SU | 1129239 | 12/1984 |

* cited by examiner

*Primary Examiner*—Melvyn Andrews
(74) *Attorney, Agent, or Firm*—Marshall & Melhorn, LLC

(57) ABSTRACT

In a device for producing sponge iron from lumps of iron oxide in a reduction shaft (1), a hot, dust-containing and carbon monoxide-rich reduction gas is used. The reduction gas is generated in a gas generator by partial oxidation of solid carbon-containing materials and is in part supplied to the reduction shaft through several lateral reduction inlets (3) arranged at the same height around the circumference of the reduction shaft at the lower end of the reduction zone. The lumps of iron oxide are introduced into the reduction shaft through its top area and discharged as sponge iron at its bottom end. Additional reduction gas inlets (15) shaped as downwardly open channels (11) which extend from the outside to the inside of the reduction shaft and/or shaped as ducts which extend obliquely downwards from the outside to the inside of the reduction shaft and have open inner ends are arranged below the plane of the lateral reduction gas inlets. Reduction gas may thus be also supplied to the radial inner area of the reduction shaft, so that the introduction of dust by the reduction gas is not limited to the outer area of the bulk material in the reduction shaft.

18 Claims, 1 Drawing Sheet

DEVICE AND METHOD FOR PRODUCING SPONGE IRON

BACKGROUND OF THE INVENTION

The invention relates to a device for producing sponge iron.

1. Field of the Invention

Lumps of iron oxide are reduced in a reduction shaft with a dust-containing and carbon monoxide-rich reduction gas from a fusion gasifier in an iron ore reduction melting plant. In this situation, only a part of the void volume of bulk material in the reduction shaft can be used to receive the dust which is introduced with the reduction gas into the reduction shaft. With plants in which the reduction shaft is connected to the fusion gasifier through downpipes, an additional amount of dust, beyond that introduced with the reduction gas, is introduced with the gasifier gas through the downpipes and discharge devices into the lower area of the reduction shaft. The dust content of this gasifier gas is several times higher than that of the reduction gas being purposefully introduced into the reduction shaft which has been previously dedusted within hot gas type cyclones. In addition to this dust, dust by virtue of the air separation of the discharged sponge iron and in case of the calcined aggregates is additionally conveyed back to the reduction shaft by the flow up of the gasifying gas. The total dust results in an increased dusting of the lower area of the reduction shaft, in channeling, hanging of the bulk material as well as in an uncontrolled discharge of the sponge iron by the discharge devices. A particularly disadvantageous effect is in that the dust passing via the downpipes from the fusion gasifier into the reduction shaft includes tar-containing and coal particles which are only partially degasified as well as other components which result in nodulizing.

With a more intensive dusting of the iron oxide bulk material in the bustle and inlet areas of the reduction gas, respectively, the pressure difference between the fusion gasifier and the lower area of the reduction shaft is increased and, accordingly, the highly dusted gasifying gas flowing up via the downpipes and screw type extractors, through which such has a direct access to the low dusted bulk material in the center of the reduction shaft. By this increased pressure difference the air separation is increased in the downpipes. Therefore, the content of dust becomes higher and higher and the bulk material in the lower area of the reduction shaft can be enriched with the circulation dust. Because of the high frictional forces within the bulk material enriched with dust, quite low pressure differences are sufficient to cause hanging of the bulk material which results in the well known phenomena of channeling and the undisturbed gas flow comprising a very high dust content from the fusion gasifier into the reduction shaft. A part of the dust is further conveyed from the lower area of the reduction shaft upwardly into the reduction zone and leads to dusting the bulk material and channeling therein as well. Such intensive dustings of the bustle area can occur if too much undersize powder is introduced with the coal by employing a greater quantity of coal in the coal mixture which highly disintegrates at high temperatures when extremely increased temperatures appear in the gasifier which result in a greater disintegration of the coal with a more intensive disintegration of the ore in the reduction shaft and with a failure and partial failure of the dust recirculation, respectively. When such cases occur the reduction shaft requires a rather long time until it cleans the dust since a part of the dust is again and again conveyed upwardly through the formed channels.

A part of the remaining void volume is filled up by the fine particles which are introduced with the raw material and which partly originate in the reduction shaft by the reduction of iron carriers and the calcination of aggregates, respectively. With this, the capacity of the reduction shaft is highly limited since a greater part of the void volume has to be maintained for the flow of the reduction gas through the bulk material, hence the specific quantity of the reduction gas required at minimum for the reduction of iron oxides and calcination of aggregates can be led through the reduction shaft having a moderate and upwardly limited pressure drop. Upon exceeding a particular pressure drop, which pressure drop depends on the particle size, particle composition and void volume of the bulk material, such well known "hanging" of the bulk material occurs as well as such channeling and cross-flow of a part of the reduction gas through the channels without being participated with the reduction process. Based on the above, the result is a low degree of metallization, low carburization of the sponge iron, a low degree of calcination of the aggregates, low plant performance as well as a poor quality of the crude iron. Hence, for normal operation a minimum specific quantity of the reduction gas is required which is led through the reduction shaft without channeling and without hanging of the bulk material. This specific required quantity of reduction gas depends on the degree of oxidation of the reduction gas, the iron content of the iron oxides, disintegrating features of the employed iron oxides at low temperatures, the quantity and disintegration features of the aggregates as well as other factors and is about 1050 mn3 reduction gas per ton of iron oxides. Because of the high temperatures of the gasifying gas and because of a low pressure drop within the bulk material serving as gas blocking means for the gasifying gas not being dedusted via the downpipes, the pressure drop is determined by a large cross section of the reduction shaft in the lower area, brick lined hot gas type cyclones having a moderate efficiency are employed as dedusting units for the reduction gas such that this still additionally contains considerable quantities of dust as well and thereby with the specific quantity of reduction gas a relatively low tolerance towards the top is given. By introduction of the reduction gas in the bustle area only at the circumference of the reduction shaft, the portion of void volume of the bulk material still being freely available for the dust separation in the radial center of the reduction shaft is hardly used. Therefore the specific quantity of reduction gas which can be led through becomes still smaller and the external ring of the bulk material within the portion of the gas inlets is more highly dusted than necessary. Then, in this external ring, channeling and hanging commence. The greater the diameter of the reduction shaft, the smaller the specific quantity of reduction gas which can be led through the reduction shaft without hanging and without channeling.

2. Description of the Prior Art

From JP-A-62294127 is previously known a device for producing sponge iron from iron oxides in a reduction shaft by using a reduction gas. This reduction gas is introduced into the reduction shaft through several gas inlets arranged at the same height around the circumference of a reduction shaft. Additionally, below the plane of these lateral gas inlets another gas inlet for the reduction gas is provided in the radial center of the reduction shaft. This gas inlet is formed by the inner open end of a pipe radially extending from the outside toward the center of the reduction shaft, with the pipe being closed in its longitudinal direction and reduction gas is supplied via the external open end thereof. By this measure a more uniform reduction of iron oxides over the shaft cross section is to be obtained. Problems involved with the introduction of a dust-containing reduction gas are not explained herein.

Moreover, U.S. Pat. No. 4,118,017 discloses a device for producing sponge iron from iron oxides in a reduction shaft by using a hot reduction gas which is supplied approximately in the central height of the reduction shaft through several gas inlets disposed around the circumference thereof. The reduction shaft tapers at the lower end wherein this end comprises several inserted truncated sections. At the outer circumference of each of these sections gas inlets for a cold reduction gas used as cooling gas for the sponge iron are located. Herein problems involved with the employment of a dust-containing reduction gas are not considered as well.

SUMMARY OF THE INVENTION

Hence, it is the object of the present invention to improve a generic device in that a carburization and enlarged reduction of the sponge iron are obtained, the low dusted bulk material in the radially central area is used for the dust separation, a greater pressure drop occurs within the bulk material in the lower area of the reduction shaft such that hot gas type cyclones having a greater pressure drop and hence a higher degree of separation can be employed for dedusting the gasifying gas used as reduction gas, the quantity of the dust-containing gasifying gas flowing via the downpipes into the reduction shaft is highly limited, and by means of a uniform dusting of the whole bulk material no additional pressure difference occurs via the pipe connections and downpipes, respectively, between the fusion gasifier and the lower part of the reduction shaft.

This object is solved according to the invention by using a hot, dust-containing and carbon monoxide-rich reduction gas, comprising a gas generator wherein the reduction gas is generated by partial oxidation of solid carbon-containing materials and a reduction shaft to which the reduction gas is supplied through several lateral reduction gas inlets which are arranged at the same height around the circumference of said reduction shaft at the lower end of the reduction zone, and the lumps of iron oxide are introduced into the reduction shaft, through a top area of the reduction shaft and discharged as sponge iron at a bottom end of the reduction shaft, characterized in that additional reduction gas inlets, at least one of said additional reduction gas inlets forming a downwardly open channel which extends from the outside into a radially central area of the reduction shaft are arranged below the plane of the lateral reduction gas inlets. Advantageous improvements of the device according to the invention result from the dependent claims.

BRIEF DESCRIPTION OF THE DRAWINGS

In the following, the invention is explained in more detail according to an embodiment shown in the figures, in which.

Figure 1:
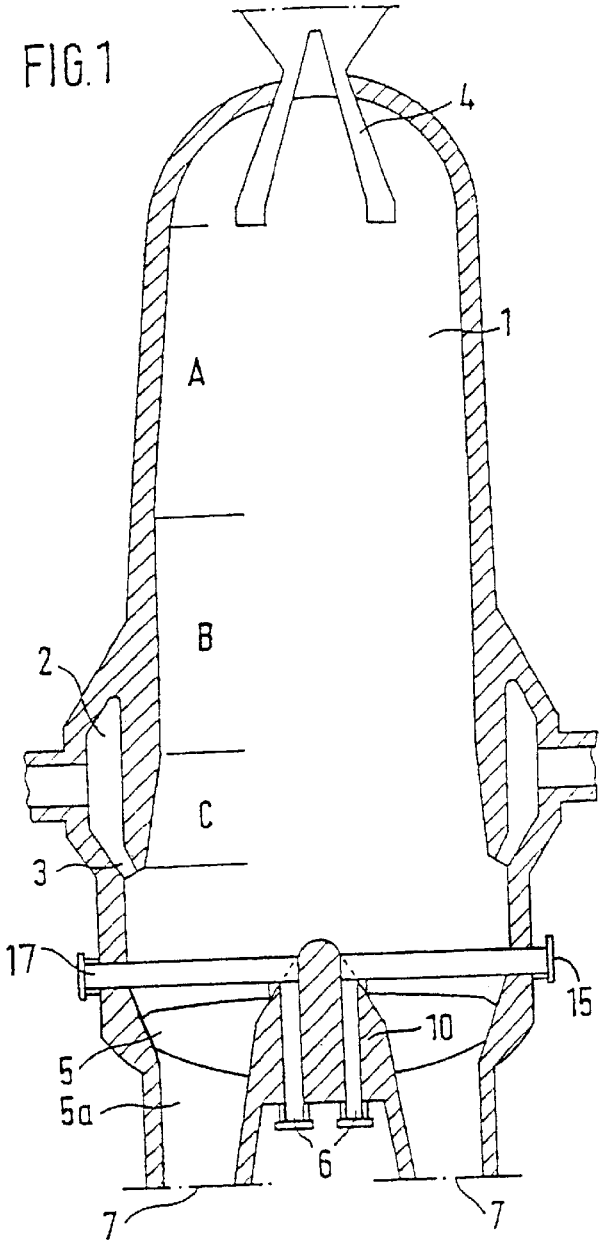
FIG. 1 shows a vertical section through a reduction shaft.
Figure 3:
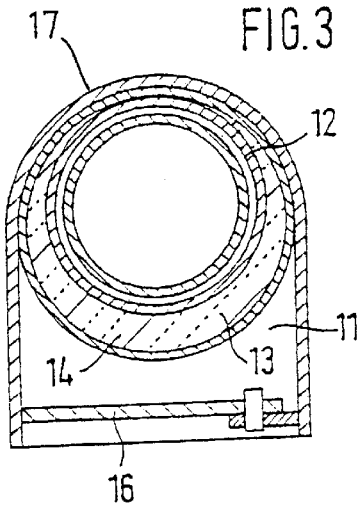
FIG. 3 shows a vertical section through a channel for feeding the reduction gas.
Figure 2:
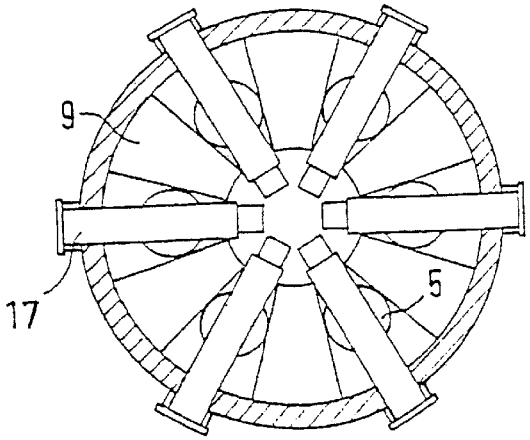
FIG. 2 shows a horizontal section through the reduction shaft according to FIG. 1 between the bustle area and the area of the channels and ducts, respectively, for the additional introduction of reduction gas.

The cylindrical reduction shaft 1 which is charged from above, that is above the reduction zone, via the distribution pipes 4, wherein only two are illustrated in FIG. 1, has a downwardly extending cross section and comprises in its upper area A a conicality of about 2°, in its central portion B, being about 5 m in height, a conicality of about 0.5°, and in its lower area C, being about 2 m in height, a conicality of 2.5°. Moreover, the reduction shaft comprises in its lower area several funnel-shaped product outlets 5 wherein only two are illustrated in FIG. 1 and six are illustrated in FIG. 2. The preferably funnel-shaped extensions and pipe connections 5*a* of the product outlets, respectively, running directly in the horizontal or slightly curvedly formed bottom of the reduction shaft 1. The product outlets 5 are formed by baffles of fireproof material, namely intermediate walls 9 and a conical block 10 in the radial center of the reduction shaft 1 having water cooled or nitrogen cooled mountings 6. A water cooled support 12 having an encompassing protection tube 13 and an insulation 14 in the lower area between these pipes being excentrically disposed to each other as well as a halfpipe shell 17 with extended lateral walls which is placed upon the support 12 and forming an open channel 11 is shown in FIG. 3. The supports 12 are disposed above the product outlets 5 and are supported with its radially inner end upon the mountings 6 of the block 10 of fireproof material. From the outside reduction gas is introduced via inlets 15 into the channels 11. In the introduction portion of the reduction gas the lateral walls of the shell 17 are drawn deeper and the brick lining is stronger performed, in order to avoid horizontal surfaces on which the deposited dust is allowed to remain placed. A greater gradient can be obtained when the gas inlets 15 are laterally disposed and obliquely with respect to the support 12. Advantageously, at the bottom end of the pipe connections 5*a* a respective discharge device being not shown in the figures is placed for the sponge iron.

A normal operation of such a plant with introducing a hot dust-containing and carbon monoxide-rich reduction gas only around the circumference of the reduction shaft 1 via the bustle channel 2 as well as the reduction gas inlets 3 by employing bulk ore is only possible with smaller reduction shafts and by employing pellets of good quality is only possible with larger reduction shafts. In comparison, it is almost indispensable with great plants being operated with normal raw materials for a part of the reduction gas to be introduced into the radial center of the reduction shaft 1 to achieve a stable operation with a wide range of performance and with more tolerance at the specific quantity of reduction gas, the dust content of the reduction gas and the choice of raw material. A reduction shaft diameter of about 5 to 6 m is allowed to be considered as a limit between these two aspects.

Having greater reduction shafts and by use of a hot dust-containing and carbon monoxide-rich reduction gas thus in the lower area of the reduction shaft several funnel-shaped product outlets 5 are formed by baffles of fireproof material, which comprise intermediate walls 9 and the conical block 10 in the central area and are provided with the mountings 6 cooled with water or nitrogen which protrude through the bottom of the reduction shaft 1 into the baffles. These mountings serve as fixing devices for the water cooled support 12 at the same time on which the shells 17 forming the channels 11 for introducing the reduction gas into the lower, predominantly radially central area of the reduction shaft 1 are suspended. With these brick lined preferably funnel-shaped pipe connections 5*a* which are welded to the bottom of the reduction shaft 1 or which are secured with flanged joints and extend the funnel-shaped product outlets 5, a steep angle is provided which is required for sliding the material and at the same time a greater height of the bulk material as gas blocking means to reduce the pressure difference between the fusion gasifier and the reduction shaft 1 is provided. The introduction of one part of the reduction gas via the inlets 15 into the radially central area of the reduction shaft 1 should take place about 2 m below the plane of the lateral reduction gas inlets 3 through at least each one channel 11 made of heat-resisting steel, which is preferably directly disposed above each product outlet 5 and above each intermediate wall 9, respectively. The channels 11 for the introduction and distribution of the reduction gas are formed by the halfpipe shells 17 of heat-resisting steel with extended lateral walls and are placed upon the water cooled tube-shaped supports 12 from above such that the extended sides of the halfpipe shells 17 form the channels 11 being open in the downward direction. This configuration is advantageous in that the large horizontal or slightly downward inclined open channels 11 may not be clogged with material or dust, very large surfaces of the bulk material relieve for introducing the reduction gas and good conditions for dust separation from the reduction gas introduced and for carrying off the dust separated within the upper areas are provided in this area by such bulk material which rapidly sinks down and is highly loosened. For the dust-containing reduction gas the access into areas of the bulk material being dusted in a smaller extent is enabled over the entire cross section of the reduction shaft 1.

The lower voluminous great part of the reduction shaft 1 serving as gas blocking means and being not participated with the reduction process which occupies almost one third of the volume of the reduction shaft 1 is used for a higher carburization and residual reduction of the sponge iron by introducing a colder reduction gas. Because of this the reduction zone and thus the entire reduction shaft can be constructed smaller and easier, thereby with reduction shafts of medium size and having a total weight of about 1500 tons and more as well as a great span of the supports a significant advantage results therefrom.

A higher content of carbon and a higher metallization of the sponge iron reduce the need of energy of the fusion gasifier and participate to a more uniform operation and better quality of the sponge iron. Hence, the reduction gas is led via the inlets 15 with a lower temperature than that of the remaining reduction gas to provide better conditions for the carburization of the sponge iron in the lower area of the reduction shaft 1. A temperature which is about 50° to 100° C. lower is to be considered as an optimum temperature for this partial flow of the reduction gas. A further cooling up to about 650° C. which was be an optimum for the carburization of sponge iron, however, would result in cooling in the center of the shaft and hence in a lower metallization in this area. By the introduction of a colder reduction gas, despite of the highly exothermal Boudouard reaction, the bulk material is cooled within this area being critical for nodulizing and its formation is avoided in conjunction with relieving bulk material from the weight of the material column thereabove by the water cooled supports 12. As is well-known, with nodulizing of calcined aggregates and tar-containing coal particles being not fully degasified which degasifying products also contain water vapor which both act as binder and main components of nodulizings having enclosed sponge iron particles and residual dust components, the temperature of the bulk material and its pressing are of significant importance. Above nodulizings once being formed, the bulk material in areas lying on top of the reduction shaft 1 falls with a lower speed.

Intensive dustings and local overheatings by the powerful exothermal Boudouard reaction are allowed to occur also in the reduction zone in some areas thereof. The arrangement of screw type extractors at the lower end of the pipe connections 5*a* is to be considered as an advantageous improvement. With such configuration the reduction shaft 1 is not required to be cleaned out during an exchange or a greater repair of the screw type extractors thereby long nonproductive periods of the production and high initiation cost are avoided.

As a result of providing downwardly open channels 11 the best conditions for the separation and conveying the separated dust are present. The halfpipe shells 17 forming the channels 11 and having extended lateral walls can be manufactured integrally or with quite a few weld seams in uncritical locations and serve as wearing protection and heat insulation for the water cooled support 12. To minimize the heat losses of the supports 12, they are provided with the additional protection tube 13 made of heat-resisting steel. The lower area which is more intensive temperature loaded between the two pipes being excentrically located to each other is filled with insulation fabric 14, and the protection tube 13 is preferably slitted particularly spaced within the upper area transversely to the axis thereof, in order to avoid a deformation by virtue of different thermal loads. The supports 12 are supported within the wall of the reduction shaft 1 and upon the mountings 6 embedded inside the intermediate walls 9 and the block 10 such that no elongated and strong supports 12 for the construction of great reduction shafts are required. It is advantageous to use the mountings 6 embedded within the conical block 10 for supporting the pipe supports 12 and the shells 17. The water cooled ducts 8 are placed at a steep angle and obliquely cut at its forward end to enlarge the blow surface of the bulk material and to avoid clogging within the ducts 8.

With a conicality selection of the reduction zone of the reduction shaft 1 the introduced dust quantity, swelling of iron oxides, disintegration characteristics and granular composition of the iron oxides and aggregates as well as the content of carbon monoxide in the reduction gas are to be considered. In the area of the lateral inlets 3 for the reduction gas up to a height of about 2 m thereabove in which the greatest dusting and greatest danger for hanging the bulk material occur, a high conicality of about 2.5° is chosen thus the bulk material is allowed to open and receive the dust. A further increased reduction of the cross section towards the top was advantageous to receive the dust but it would result in a higher increase of the specific pressure drop in the upper areas of the reduction shaft 1 by increasing the gas temperature and gas speed, respectively. In this area, the carburization of the sponge iron and heating of the entire area take place by the highly exothermal Boudouard reaction, wherein the decrease of the gas quantity by carburization of the sponge iron is more than compensated by an increase of the gas quantity based on an intensive calcination of the aggregates. With a gas temperature rise of 80° C. the specific pressure drop will increase up to 15% with a constant cross section. For this reason a smaller angle of conicality of about 0.5° is chosen in this area which is about 3 to 5 m in height. A greater weight of the material column existing thereabove speaks in favor of a small angle and more specific pressure drop by more intensive dusting than in the upper areas. Because of this a higher pressure drop and more intensive dusting in this area can be permitted. In the area thereabove a conicality of about 2° is to be considered as an optimum.

Charging the reduction shaft 1 with iron oxides being in case mixed with aggregates occurs via the distribution pipes 4 disposed in the upper area within a circle having its center in the longitudinal axis of the reduction shaft 1. The number of distribution pipes at least corresponds to the twice number of product outlets 5. With greater reduction shafts such distribution pipes should be mounted in two circles and in a greater number to minimize the segregation of burdening and to avoid an intensified gas flow in the marginal area and in the center of the reduction shaft caused by an intensive M-profile. The distribution pipes 4 are symmetrically disposed toward the axis of the product outlets 5. Thus, it is obtained for the bulk material below such distribution pipes 4 being more rich of fine granulation and falling with a lower speed than such a more coarse bulk material, to fall down with an increased speed through respective two distribution pipes 4 which are directly disposed above the two catchment areas of the screw type conveyors, namely between the respective channel 11 and the two adjacent intermediate walls 9 thereof.

The quantity of reduction gas introduced via inlets 15 into the central area of the reduction shaft 1 is advantageous with about 30% of the total quantity of the reduction gas with medium sized reduction shafts such that an external ring having a great surface is supplied with about 70% of the reduction gas via the bustle channel 2 and inlets 3. By such a reduction of 30% of the gas quantity fed via the bustle channel 2 the load of bulk material is also reduced by about 30% in this area having the dust, thereby, during a normal operation channeling and hanging of the bulk material are no longer to be expected. A smaller portion of the reduction gas introduced via the channels 11 which are downwardly open will flow into the external ring as well, however, the main quantity will flow into the radially central area in the bulk material of the reduction shaft 1 being dusted in a smaller extent. With great reduction shafts the introduced quantity of the reduction gas into the radially central area of the reduction shaft will correspondingly increase.

The supports 12 also carry a great portion of the weight of the material column lying thereabove such that they relieve and loosen up the bulk material within the product outlets 5 and bridging does not occur inside this funnel-shaped areas being downwardly narrowed.

The channels 11 may be mounted star-like or in parallel to each other. The feeding pipes towards these are layed with descending gradient, hence these do not clog which is caused by dust deposits and pushing back the bulk material during pressure variations in the system.

The extended lateral walls of the shells 17 forming the channels 11 being downwardly open in particular distances the provided with stiffenings and distance pieces 16, thus the contraction of the channel by compressing the walls being in parallel to each other caused by the bulk material is avoided.

What is claimed is:

1. Device for producing sponge iron from lumps of iron oxide in a reduction shaft (1) by using a hot, dust-containing and carbon monoxide-rich reduction gas, comprising a gas generator wherein the reduction gas is generated by partial oxidation of solid carbon-containing materials and a reduction shaft (1) to which the reduction gas is supplied through several lateral reduction gas inlets (3) which are arranged at the same height around the circumference of said reduction shaft (1) at the lower end of the reduction zone, and the lumps of iron oxide are introduced into the reduction shaft (1) through a top area of the reduction shaft and discharged as sponge iron at a bottom end of the reduction shaft, characterized in that additional reduction gas inlets (15) at least one of said additional reduction gas inlets forming a downwardly open channel (11) which extends from the outside into a radially central area of the reduction shaft (1) are arranged below the plane of the lateral reduction gas inlets (3).

2. Device according to claim 1, characterized in that said gas generator is a melting gasifier and the bottom end of said reduction shaft (1) is connected to a head of said melting gasifier to supply sponge iron from said reduction shaft (1) into said melting gasifier.

3. Device according to claim 1, characterized in that funnel-shaped product outlets (5) are formed by baffles (9, 10) of fireproof material in the lower area of said reduction shaft (1).

4. Device according to claim 3, characterized in that said baffles are formed of radially extending intermediate walls (9) and a block (10) which extends conically downwards in the radially central area of said reduction shaft (1).

5. Device according to claim 3, characterized in that mountings (6) for inner ends of halfpipe shells forming said at least one channel (11) duct are embedded into said baffles (9, 10).

6. Device according to claim 3, characterized in that said respective one channel (11) is arranged above said each product outlet (5).

7. Device according to claim 1, characterized in that the feeding pipes have a descending slope towards said channels (11).

8. Device according to claim 1, characterized in that said each channel (11) is enclosed by heat-resisting steel and arranged below a water cooled support (12) extending in the same direction as the corresponding water cooled support and is suspended thereon.

9. Device according to claim 8, characterized in that said channels (11) are formed by halfpipe shells being downwardly open and which have downwardly extended parallel walls and are placed upon said supports (12).

10. Device according to claim 9, characterized in that a protection tube (13) surrounds said supports (12) and forms a space therebetween and the space therebetween is filled with insulating fabric (14).

11. Device according to claim 9, characterized in that the parallel walls have a variable height and that the height of the parallel walls decreases towards the center of the reduction shaft (1).

12. Device according to claim 1, characterized in that said channels (11) are arranged in star-like manner.

13. Device according to claim 1, characterized in that said reduction shaft (1) has a circumference which is larger near the bottom of the reduction shaft than near the top of the reduction shaft with a graduated conicality.

14. Device according to claim 3, characterized in that in the upper area of said reduction shaft (1) distribution pipes (4) are provided for charging with iron oxides and which number of distribution pipes is twice the number of said product outlets (5) and which are arranged circumferentially circularly and symmetrically towards these.

15. A method for producing sponge iron from lumps of iron oxide in a reduction shaft (1) by using a hot, dust-containing and carbon monoxide-rich reduction gas, comprising generating the reduction gas in a gas generator by partial oxidation of solid carbon-containing materials and supplying said reduction gas to said reduction shaft (1) through several lateral reduction gas inlets (3) arranged at the same height around the circumference of said reduction shaft (1) at the lower end of the reduction zone, and introducing the lumps of iron oxide into the reduction shaft (1) through a top area and discharged as sponge iron at a bottom end, and wherein additional reduction gas inlets (15) at least one of said additional reduction gas inlets forming a downwardly open channel (11) which extends from the outside into a radially central area of said reduction shaft (1)

are arranged below the plane of said lateral reduction gas inlets (3), characterized in that the reduction gas supplied via said channels 11) and/or said ducts (8) has a lower temperature than the reduction gas supplied at the lower end of the reduction zone.

16. A method according to claim 15, characterized in that the temperature of the reduction gas supplied via said channels (11) is about 50° C. less than the temperature of the reduction gas supplied at the lower end of the reduction zone.

17. A method for producing sponge iron from lumps of iron oxide in a reduction shaft (1) by using a hot, dust-containing and carbon monoxide-rich reduction gas, comprising generating the reduction gas in a gas generator by partial oxidation of solid carbon-containing materials and supplying the reduction gas into said reduction shaft (1) through said several lateral reduction gas inlets (3) arranged at the same height around the circumference of said reduction shaft (1) at the lower end of the reduction zone, and introducing the lumps of iron oxide into said reduction shaft (1) through a top area and discharging the sponge iron at a bottom end, and wherein additional reduction gas inlets (15), at least one of said additional reduction gas inlets forming a downwardly open channel (11) which extends from the outside into the radially central area of said reduction shaft (1) are arranged below the plane of said lateral reduction gas inlets (3), characterized in that the portion of the reduction gas supplied via said channels (11) is approximately 30% of the total quantity of the reduction gas.

18. A method for producing sponge iron from lumps of iron oxide in a reduction shaft (1) by using a hot, dust-containing and carbon monoxide-rich reduction gas, comprising generating the reduction gas in a gas generator by partial oxidation of solid carbon-containing materials and supplying said reduction gas to said reduction shaft (1) through said several lateral reduction gas inlets (3) arranged at the same height around the circumference of said reduction shaft (1) at the lower end of the reduction zone, and introducing the lumps of iron oxide into said reduction shaft (1) through its top area and discharging sponge iron at its lower end, and wherein additional reduction gas inlets (15) forming at least one downwardly open channel (11) which extends from the outside into the radially central area of said reduction shaft (1) are arranged below the plane of said lateral reduction gas inlets (3), characterized in that the reduction gas supplied at the lower end of the reduction zone is largely cleaned from dust within hot gas type cyclones.

* * * * *